US005581520A

United States Patent [19]

Ogden

[11] Patent Number: 5,581,520

[45] Date of Patent: Dec. 3, 1996

[54] WATCH DRIVEN ELAPSED TIME INDICATOR APPARATUS AND ITS METHOD OF MANUFACTURE AND USE

[75] Inventor: Gerald W. Ogden, Elgin, Ill.

[73] Assignee: Electrodynamics, Inc., Rolling Meadows, Ill.

[21] Appl. No.: 183,068

[22] Filed: Jan. 18, 1994

[51] Int. Cl.[6] ..... G04B 19/00; G04F 8/00

[52] U.S. Cl. ..... 368/76; 368/9; 368/222

[58] Field of Search ..... 368/76, 78, 220, 368/222, 235, 5, 61, 8, 9, 10, 107–113

[56] References Cited

U.S. PATENT DOCUMENTS

| | | | |
|---|---|---|---|
| D. 332,923 | 2/1993 | Polydoris et al. | D10/100 |
| 2,636,339 | 4/1953 | Holzner | 368/78 |
| 2,734,338 | 4/1956 | Uhlig | 368/78 |
| 3,328,954 | 7/1967 | Miller | 368/78 |
| 3,609,310 | 9/1971 | Cetran | 235/92 |
| 3,721,086 | 3/1973 | Flumm | 368/222 |
| 3,725,947 | 4/1973 | Albertini et al. | 346/33 R |
| 3,823,546 | 7/1974 | Gortz et al. | 58/23 R |
| 3,899,872 | 8/1975 | Flumm et al. | 368/222 |
| 3,908,354 | 9/1975 | Tomasello | 58/23 D |
| 3,911,446 | 10/1975 | Albertini | 346/33 R |
| 3,943,526 | 3/1976 | Albertini et al. | 346/25 |
| 4,012,898 | 3/1977 | Yoshizawa | 58/2 |
| 4,031,448 | 6/1977 | Adachi | 318/696 |
| 4,092,823 | 6/1978 | Shiro | 58/125 |
| 4,207,733 | 6/1980 | Copeland et al. | 368/108 |
| 4,277,841 | 7/1981 | Ogden | 368/78 |
| 4,423,965 | 1/1984 | Muller et al. | 368/78 |
| 4,472,964 | 9/1984 | Kluger | 73/116 |
| 4,568,197 | 2/1986 | Lam | 368/235 |
| 4,922,474 | 5/1990 | Groothuis | 368/113 |
| 4,937,798 | 6/1990 | Zepf | 368/78 |
| 4,941,136 | 10/1990 | Breitung, II | 368/8 |
| 4,985,875 | 1/1991 | Mitchell | 368/5 |
| 5,121,368 | 6/1992 | Polydoris et al. | 368/9 |

FOREIGN PATENT DOCUMENTS

| | | | |
|---|---|---|---|
| 3526028 | 1/1987 | Germany | G04B 19/00 |
| 1154648 | 5/1985 | U.S.S.R. | G04G 3/00 |

*Primary Examiner*—Vit W. Miska
*Attorney, Agent, or Firm*—Donald J. Lisa

[57] ABSTRACT

An elapsed time hour meter for measuring and indicating an amount of elapsed time used in many types of applications. The elapsed time hour meter has a cylindrical rotating counter indicator that indicates the amount of elapsed time, and it is driven by an electrically powered watch movement. The gear work of the elapsed time hour meter couples the watch movement to the rotating counter whereby the watch movement drives the counter indicator to measure and indicate the actual amount of elapsed time. The watch movement is a reliable production wrist watch without battery, face and hands and to the minute stem of which is affixed a minute gear coupled to an intermediate gear supported on a lower housing half which couples to the counter indicator. The power supply elements and external terminals are supported in the upper housing half. The elapsed time hour meter is versatile and reliable and has the advantages of being small in size, low in cost, and low in power consumption.

12 Claims, 6 Drawing Sheets

WATCH DRIVEN ELAPSED TIME INDICATOR APPARATUS AND ITS METHOD OF MANUFACTURE AND USE

BACKGROUND OF THE INVENTION

1. Fields Of The Invention

The present invention relates generally to an elapsed time hour meter which measures and indicates an amount of elapsed time, and, more particularly, to an elapsed time hour meter having a rotating counter indicator driven by an electrically powered time movement.

2. Discussion Of Background And Prior Art a. Versatility And Reliability

Time meters that measure and indicate an amount of elapsed time are useful in many types of application. These time meters are particularly useful in keeping track of the amount of time that electrical or mechanical machinery or equipment (i.e. compressors, generators, computers, business machines, engines, etc.) have been operated, and this elapsed time information is useful to the operator in determining whether the machinery or equipment should or needs to be serviced or replaced. In order to adapt to a wide range of environments, it is important that such time meters be versatile and reliable in accurately measuring and indicating the actual amount of elapsed time. However, in order to provide such versatility and reliability, typically a large number of complex components are required to be used in the construction of the time meter. Therefore, there is a need for a time meter that has fewer and less complicated components while at the same time is still versatile and highly reliable. It is an object of the present invention to provide such a time meter.

b. Cost And Power Consumption

The use of many and complex components either drives up the cost of the time meter (i.e. more components or complex components increase the expense of the meter) or requires a higher consumption of power to operate the time meter (i.e. larger number of gears results in more friction to be overcome or more complex components require the higher power consumption). Additionally, because miniaturization also increases costs, therefore, larger sized components are often used in order to simplify the mechanisms and keep the costs of the time meter low while at the same time providing a time meter that is both accurate and reliable. However, when larger sized components are used, higher power consumption results (i.e. more torque required to move each component). Therefore, there is a need for a time meter that is not only low in cost, but also, low in power consumption. It is an object of the present invention to also fill this need.

c. Overall Size

Another factor that must be considered in designing and making a time meter is the overall size of the meter. Since the time meter may be used in an environment which has only a limited amount of physical space (i.e. a computer, miniature electronic circuit, etc.), it is desired that a small-size time meter be provided so that it can conveniently be placed and mounted in these environments. However, as stated earlier, in reducing the size of components, a manufacturer/designer must use care because miniaturization may increase the costs and/or reduce the reliability of the time meter. Therefore, there is a need for an overall small time meter that does not sacrifice low cost in achieving that dimension. It is an object of the present invention to also fill this need.

d. Prior Art

A typical prior time meter is described in U.S. Pat. No. 5,121,368 to Polydoris et al. ("'368 Patent") which discloses an engine operating time measuring apparatus. The assembly of this apparatus includes a mechanical counting apparatus driven by a quartz-crystal based clock movement mechanism. Because the time measuring apparatus incorporates the use of a clock movement, it is large in size and high in power consumption. Moreover, because this time measuring apparatus focuses on first subassembling the entire meter prior to its insertion into its housing, the apparatus requires additional components including a clock case and counter frame in order to form the subassembly. The use of these additional components further adds to the cost, complexity and large overall size of the meter.

Therefore, there is still a need for a time meter that is versatile, accurate, and reliable while at the same time generally low in cost, low in power consumption, small in size, and adapted for use in a variety of applications. The present invention overcomes these problems.

SUMMARY OF THE INVENTION

Set forth below is a brief summary of the invention which solves the foregoing problems and achieves the foregoing and other objects, benefits, and advantages in accordance with the purposes of the present invention as embodied and broadly described herein.

One aspect of the invention is an elapsed time hour meter apparatus for measuring and indicating an amount of elapsed time. This apparatus has a cylindrical rotating counter indicator for indicating the amount of elapsed time, an electrically powered watch movement, means for receiving a supply of electrical power to power the watch movement, a gearwork coupling the watch movement to the rotating counter indicator whereby the counter indicator is driven by the watch movement, and a housing for holding the components of the time hour meter together that further has means for displaying the amount of elapsed time.

A further feature of this aspect of the invention is that the electrically powered watch movement is a production wrist watch without battery, face and hands and is adapted to drive the rotating counter indicator by coupling a minute gear to a minute movement of the watch movement.

A further feature of this aspect of the invention is a housing having two halves and a portion of the gear works is rotatably supported on the inner wall of one housing half.

A second aspect of the invention is a method for measuring and indicating an amount of elapsed time using an elapsed time hour meter having the steps of providing a cylindrical rotating counter indicator that measures and displays the amount of elapsed time, adapting an electrically powered watch movement for driving the counter indicator, coupling the electrically powered watch movement to the counter indicator, electrically powering the watch movement whereby the watch movement drives and effects proper rotation of the counter indicator, housing the counter indicator and watch movement in operative relation and displaying the amount of elapsed time.

DETAILED DESCRIPTION OF THE INVENTION

FIGS. 1–11 show the assembly of an embodiment of a watch driven elapsed time hour meter in which a reliable production wrist watch movement has been taken and adapted to drive the elapsed time hour meter. This embodiment has unique features and advantages that allow it to overcome the limitations and problems of the prior art elapsed time hour meters. The embodiment and its unique features and advantages are now described in more detail.

1. Overall Description Of The Watch Driven Elapsed Time Hour Meter

Figure 1:
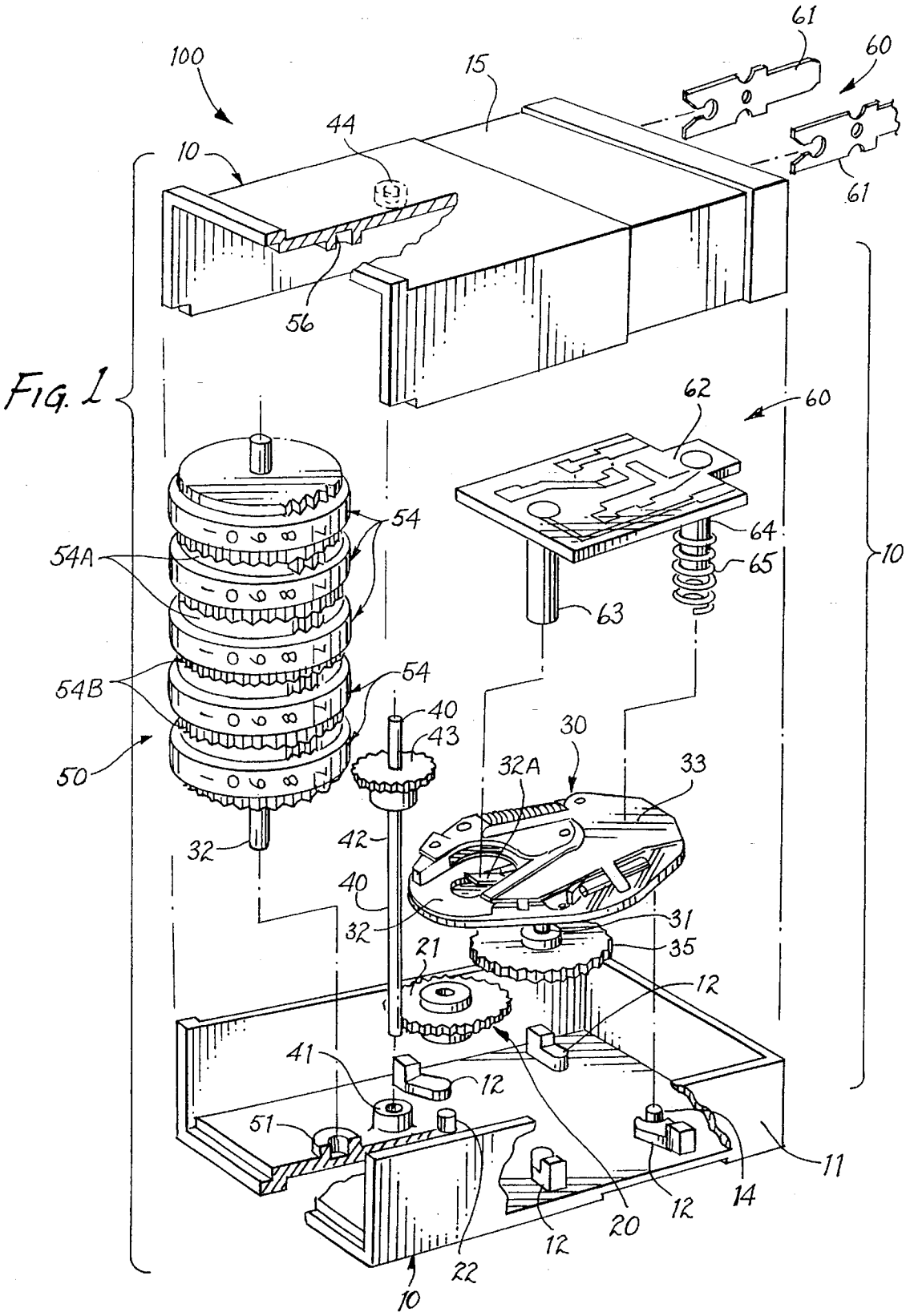
FIG. 1 —Exploded perspective view of the elapsed time hour meter showing the various assemblies of components.

FIG. 1 shows an exploded view of an assembly of components for a watch driven elapsed time hour meter 100. Referring to FIG. 1, the watch driven elapsed time hour meter 100 generally has five main components: a cylindrical rotating counter indicator 50 for indicating the amount of elapsed time, electrically powered watch movement structure 30 for driving the elapsed time hour meter, means for receiving a supply of electrical power 60 coupled to the watch movement structure 30 for providing electrical power thereto, a gearwork (i.e. an intermediate gear 20 intermeshing with a minute gear 31 from the watch movement structure 30 that couples the watch movement structure 30 to the counter indicator 50 so that the watch movement 30 drives the rotating counter indicator 50 which indicates the amount of elapsed time), a housing structure 10 for holding the components of the watch driven elapsed time hour meter together. The assembly of each of these components are now described in more detail.

2. Intermediate Gear Assembly And Watch Movement Adaption And Assembly

Figure 2:
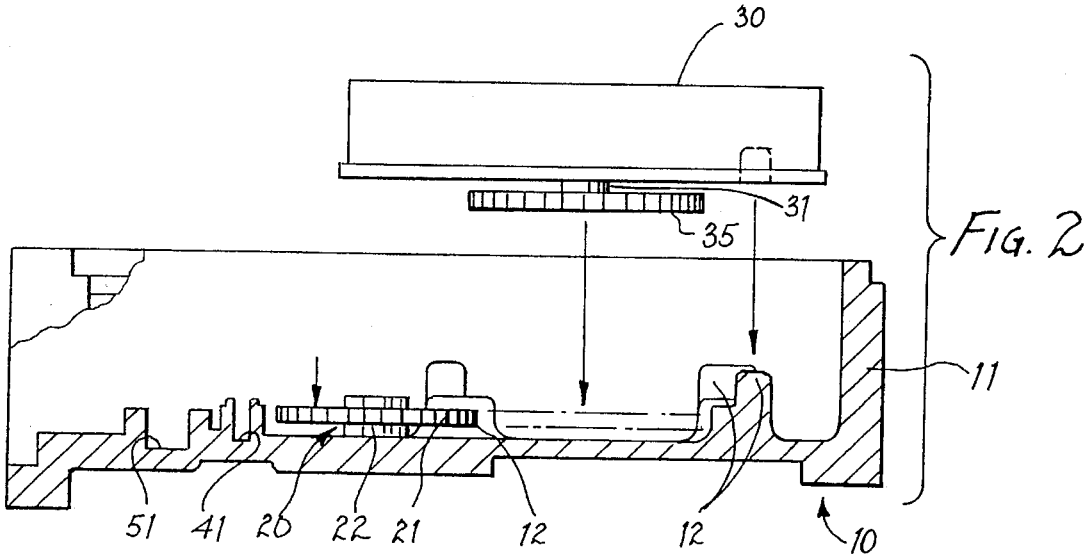
FIG. 2—Side sectional view of an electrically powered watch movement structure being mounted into a lower casing of the elapsed time hour meter.

Referring to FIG. 2, the assembly of the watch driven elapsed time hour meter 100 begins with providing a premolded lower half casing 11 of the housing 10. Lower casing 11 is premolded into a cup shape so that it can receive and hold various components of the elapsed time hour meter 100. It has a large opening in the left sidewall adjacent to where the counter indicator 50 is to be mounted so that the amount of elapsed time may be viewed through that opening of the housing 10. Lower casing 11 is pre-molded with four L-shaped chair mounts 12 which receive and support the watch movement structure 30, an intermediate gear pin 22 for receiving the intermediate gear 21, a circular recess 41 for receiving the index pinion assembly shaft 42, and a circular recess 51 for receiving the counter indicator assembly shaft 52.

Figure 3:
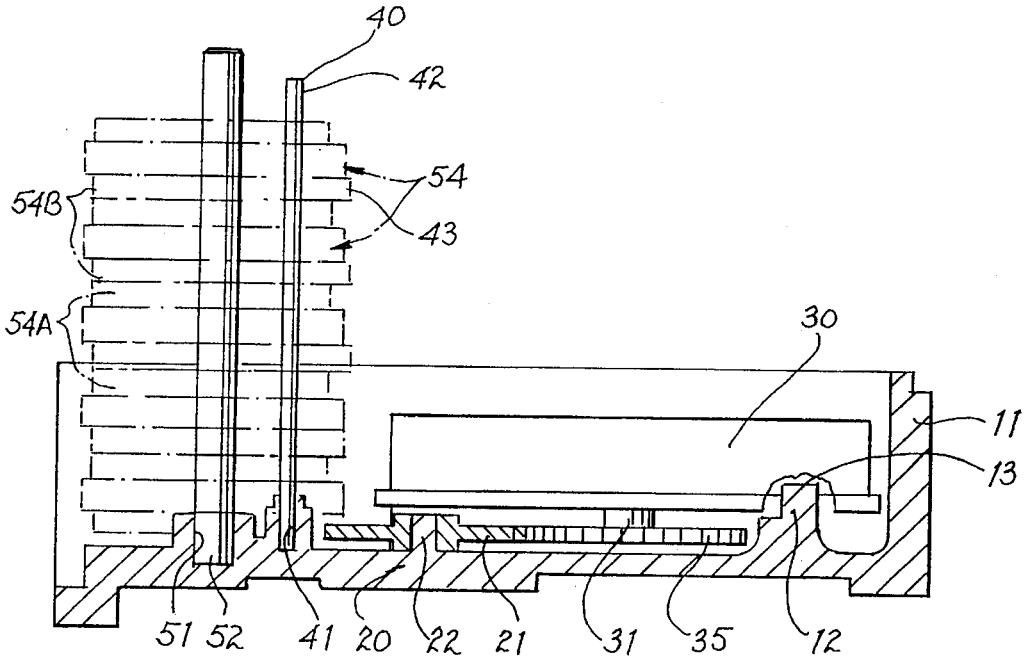
FIG. 3—Side sectional view of the counter indicator assembly and the index pinion assembly mounted to the lower casing of the elapsed time hour meter.

An intermediate gear 21 is placed onto the intermediate gear pin 22 to form the intermediate gear assembly 20. A watch movement structure 30 is taken from a production watch, such as the reliable, production, pre-assembled CITIZEN™ quartz watch, model MIYOTA™ 2025. The watch movement structure 30 is a plate structure, as shown in FIG. 1, 2, or 3, and is adapted to drive the elapsed time hour meter 100 by removing the face or hands of the watch and the hour wheel and stem as well. As shown in FIGS. 1 or 2, a new minute gear 35 is attached to the minute stem 31 of watch movement structure 30. In FIGS. 2 and 3 the watch movement structure 30 with the new minute gear 35 is then lowered into the lower casing 11. The horizontal or seat portion of chair mounts 12 in lower casing 11 receive and the vertical or upright portion of chair mounts 12 guide and position the watch movement structure 30 into lower casing 11.

An additional positioning post 14, as shown in FIG. 1, that is molded into lower casing 11 receives a cooperating recess in the bottom of the watch movement structure 30, and this positioning post 14 allows further accurate positioning of the watch movement structure 30 into lower casing 11. Watch movement structure 30 is placed into position into the casing 11 so that the minute gear 35 intermeshes with the intermediate gear 21, which has already been mounted into place. The minute gear 35 can be further ensured to properly mesh with the intermediate gear 21 by shaking the watch movement structure 30 slightly during its insertion onto chair mounts 12 in the lower casing 11. The vertical portions of the four L-shaped chair mounts 12 are then heat staked over the top edge of the watch movement structure 30 casing so that the watch movement structure 30 is locked into the lower casing 11.

3. Counter Indicator Assembly

Figure 3C:
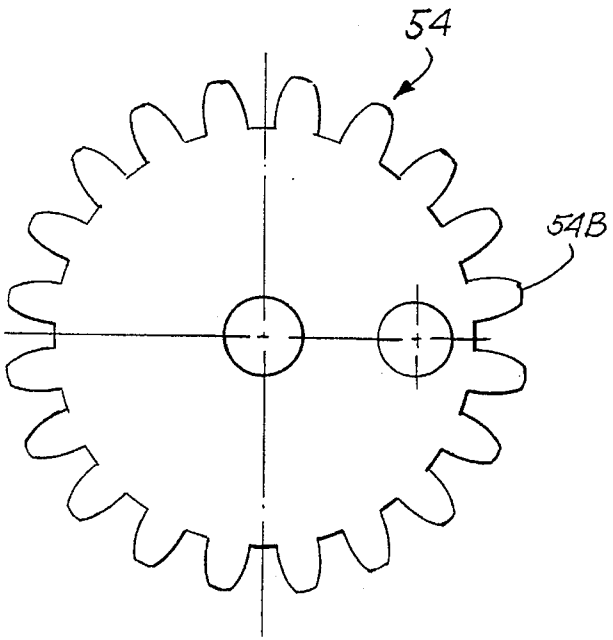
FIG. 3*c*—Left side view of FIG. 3*a*.
Figure 3A:
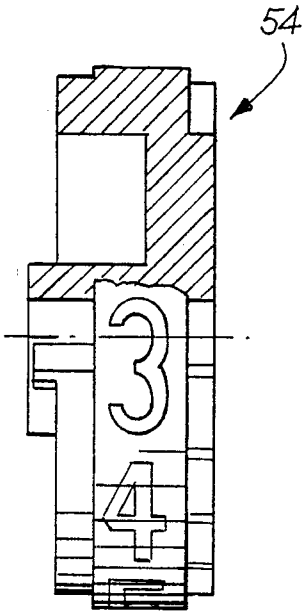
FIG. 3*a*—Front elevational view in partial section of an upright indicator wheel.
Figure 3B:
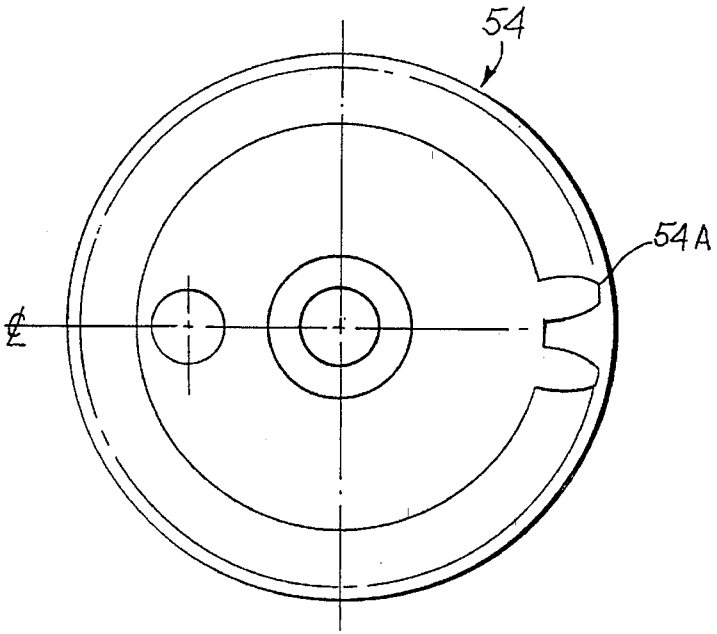
FIG. 3*b*—Right side view of FIG. 3*a*.
Figure 6:
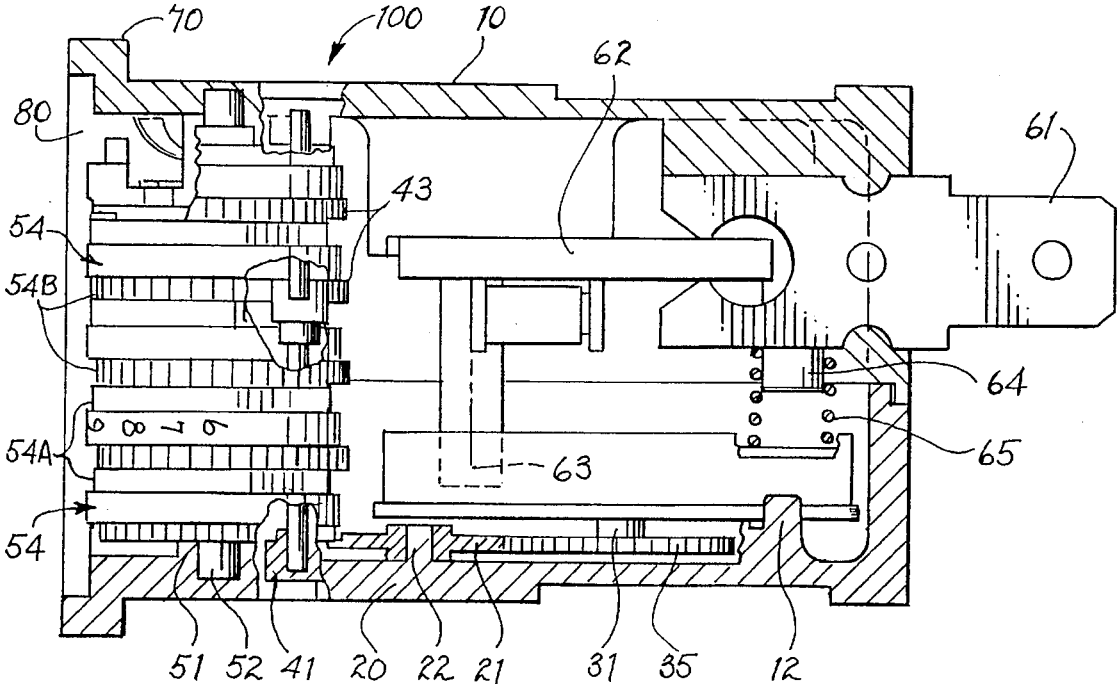
FIG. 6—Side view in partial section of the elapsed time hour meter.
Figure 10:
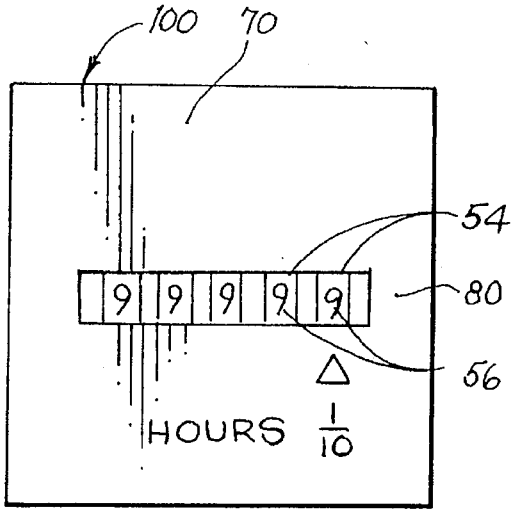
FIG. 10—Front view showing the face of the assembled elapsed time hour meter.

Referring to FIG. 3, the counter indicator assembly 50 and its associated index pinion assembly 40 are next assembled onto the lower casing 11. Index pinion shaft 42 is inserted into circular recess 41 and counter indicator shaft 52 is inserted into circular recess 51 of lower casing 11. Counter indicator assembly 50 and its index pinion assembly 40 are assembled using well known conventional technology. (FIG. 3 shows the indicator wheels 54 mounted to the counter indicator shaft 52 in phantom). The assembly involves step by step insertions of the counter indicator components. A first index pinion 43 is positioned onto the index pinion shaft 42. Each indicator wheel 54 has two gear teeth 54A on its top side and a full spur set of gear teeth 54B on its bottom side as shown in FIGS. 3B and 3C. A first indicator wheel 54 is then positioned onto shaft 52 so that it properly intermeshes with intermediate gear 21 and first index pinion 43, and the proper meshing of these gears is further ensured by shaking the first indicator wheel 54 slightly during initial positioning. Assembly continues by sequentially and alternately positioning an index pinion 43 onto index pinion shaft 42 and an indicator wheel 54 onto indicator wheel shaft 54 so that an index pinion gear 43 is placed between every two adjacent indicator wheels 54. The two gear teeth 54A of the last indicator wheel 54 inserted are not utilized. As shown in FIGS. 1, 3A, or 6, indicator wheels 54 each have a set of indicias in a sequential order numbered from 0 to 9 in order to indicate the amount of elapsed time. Each wheel 54 is placed adjacently on top of each other to represent an incremental order of a selected unit of time (i.e. tenths, ones, tens, hundreds, etc. of unit at time). The two gear teeth 54A on each indicator 54 are aligned with the indicia number of highest order (i.e. "9"). An index pinion 43 is placed between every two adjacent indicator wheels 54 so that index pinion 43 intermeshes with the full spur set of gear teeth 54B from the indicator wheel 54 of higher incremental order and is driven by the two gear teeth 54A of the indicator wheel 54 of lower incremental order. Indicator wheels 54 and index pinion gears 43 are sequentially and alternatively placed on their respective shaft so that a "9" on each indicator wheel 54 faces outwardly through the opening of the time meter housing 10 so that a number having all digits 9 is displayed by the elapsed time hour meter, as shown in FIG. 10.

4. The Means For Receiving A Supply Of Electrical Power

Figure 4:
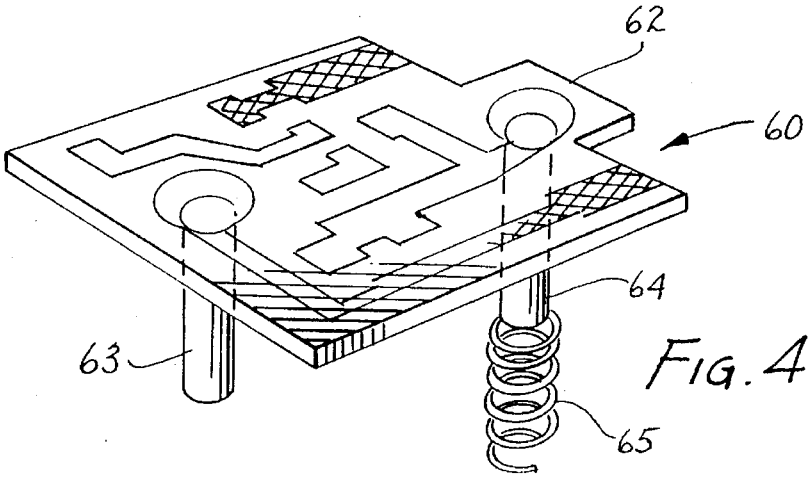
FIG. 4—Perspective view of a circuit board used by the elapsed time hour meter for receiving a supply of electrical power.
Figure 5:
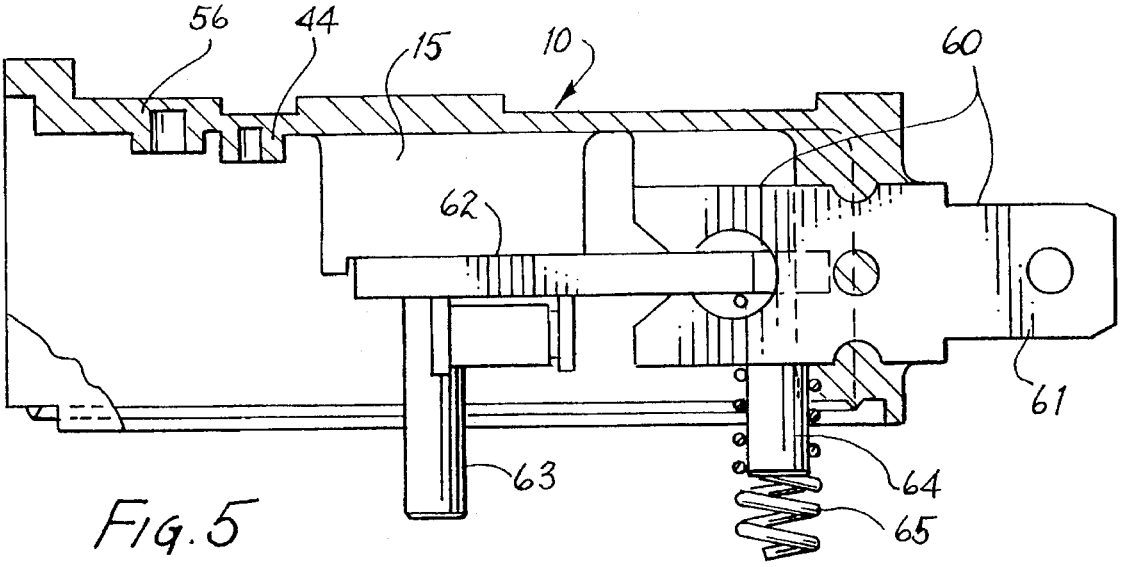
FIG. 5—Side sectional view of the upper casing of the elapsed time hour meter having the attached circuit board and electrical terminals that are used by the elapsed time hour meter for receiving a supply of electrical power.

Means 60 for receiving a supply of electrical power to the time meter 100 is shown in FIG. 1 or 5, and it has two main components: a printed circuit board 62 and a pair of electrical terminals 61. Means 60 couples to the watch movement structure 30 so that electrical power can be supplied to it. The pair of electrical terminals 61 contact the circuit board 62 and protrude from the time meter housing 10 so that they can contact an electrical power source. The two electrical terminals 61 are pre-molded into the right side wall of an upper casing 15 of the housing 10. One end of each terminal 61 extends through the side wall so that the terminal pair can be plugged into an external power source. The other end of each terminal 61 has a U-shaped, spring clip. These spring clips of terminal 61 receive and engage two metal contact strips on the printed circuit board 62. When the terminals 61 are plugged into a power source, a voltage is then provided to the time hour meter 100. As seen in FIG. 4, of the printed circuit board 62 comprises a voltage regulator circuit (components on underside of board 62 not shown in FIG. 4) that regulates the incoming voltage supplied by the external power source to the time hour meter 100. The voltage regulator circuit can be made to regulate low DC voltages (i.e. 4–34 V DC), high DC voltages (i.e. 20–100 V DC) or AC voltages (i.e. 100–130 V AC). The printed circuit board 62 is pre-assembled to have a pair of electrical contact strips one each of which receives one U-shaped spring clip of terminals 61.

Printed circuit board 62 is further pre-assembled with two contact posts as shown in FIG. 4 or 5. One of the contact posts 63 is a negative contact post that has one end attached to a negative contact strip on the printed circuit board 62 and has the other end electrically coupled to a negative contact strip that is in the watch movement structure 30. The negative contact strip 32*a* is a leaf spring in a well 32 in the watch movement structure 30 which is the negative terminal that the watch battery normally contacts. The other contact post 64 is a positive contact post that has one end attached to a positive contact strip on the printed circuit board 62 and has the other end electrically coupled to a positive plate structure 33 of the watch movement structure 30. A spring 65 is superimposed on positive contact post 64 and acts as an extension of post 64. Spring 65 is needed for applying pressure to the watch movement plate structure 30 so that contact of post 64 is in effect made and ensured to the positive plate structure 33 of watch movement structure 30, and therefore, spring 65 couples the positive contact post to the positive plate structure.

As shown in FIG. 5 printed circuit board 62 is then inserted into the upper casing 15. The electrical contact strips of the printed circuit board 62 are positioned within the U-shaped, spring clip portion of terminal 61 which are pre-molded into the interior of upper casing 15. These U-shaped clips of terminals 61 securely hold the printed circuit board 62 in place within the upper casing 15.

Upper casing 15 with its assembly components is then mounted to lower casing 11. As shown in FIG. 1 or 5, a circular recess 56 for receiving the other end of counter indicator shaft 52 and a circular recess 44 for receiving the other end of index pinion shaft 42 are pre-molded into the end wall of the upper casing 15. Upper casing 15 is then assembled to the lower casing 11 so that an end of the counter indicator shaft 52 and an end of the index pinion shaft 42 are inserted into circular recess 56 and circular recess 44, respectively. Furthermore, when upper casing 15 is assembled to lower casing 11, the negative contact post 63 and spring 65 of the printed circuit board 62 are inserted respectively into recess 32 and recess 33 of watch movement plate structure 30 so that they make mechanical and electrical contact with their respective contact strip on the watch movement structure 30.

Upper casing 15 also has a large opening in the left sidewall where the counter indicator 50 is adjacently mounted. This opening allows the counter indicator 50 to display a number represented by a series of indicias 56 from the indicator wheels 54 and this number represents the amount of elapsed time in a selected unit. The upper casing 15 and the lower casing 11 hold the components of the elapsed time hour meter 100 together and these two casings are ultrasonically welded together in forming housing 10 to ensure that the components of time meter 100 are securely attached together.

The elapsed time hour meter 100 is now fully operational if power is applied to the watch movement structure 30. The watch movement structure 30 drives minute gear 35 which in turn drives the intermediate gear 21. Intermediate gear 21 then rotates to drive counter indicator 50. Counter indicator 50 has an index pinion assembly 40 that effects the proper rotation of each indicator wheel 54 so that proper amount of elapsed time is measured and indicated.

5. The Bezel And Window

Figure 8:
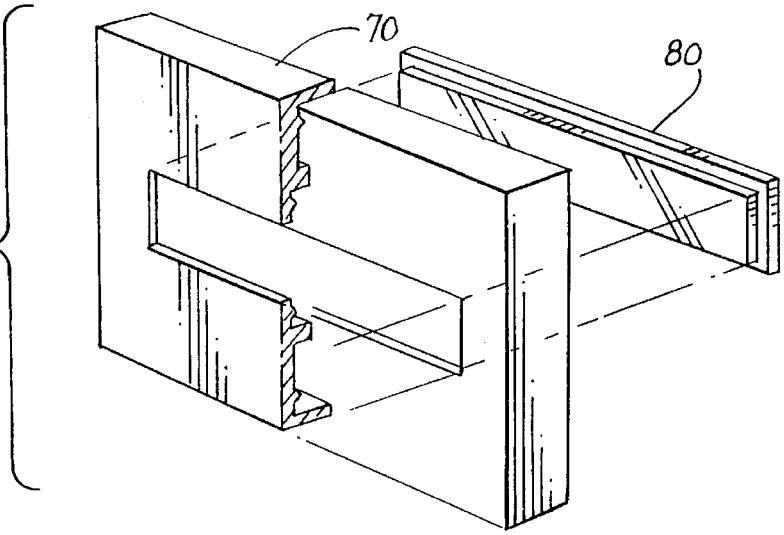
FIG. 8—Perspective view in partial section of the bezel and window that attach to the elapsed time hour meter housing.
Figure 11:
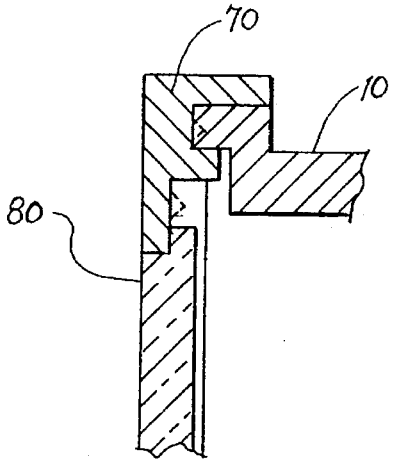
FIG. 11—Cross sectional view of the assembled elapsed time hour meter taken along the line 11—11 of FIG. 9.

Referring to FIGS. 8 and 11, a window 80 is then inserted into an opening of the bezel 70, and ultrasonically welded thereto. The assembly of elapsed time hour meter 100 is fully completed by placing a bezel 70+80 over the opening in housing 10 adjacent to counter indicator 50 (i.e. the front face of the elapsed time hour meter 100), and bezel 70 is ultrasonically welded thereto. Bezel 70 and window 80 allow the elapsed time hour meter 100 to be in a closed, sealed casing, and they further provide a means for displaying the amount of elapsed time through time meter housing 10. FIG. 11 shows the assembly of bezel 70 and window 80 to the time meter housing 10.

Figure 7:
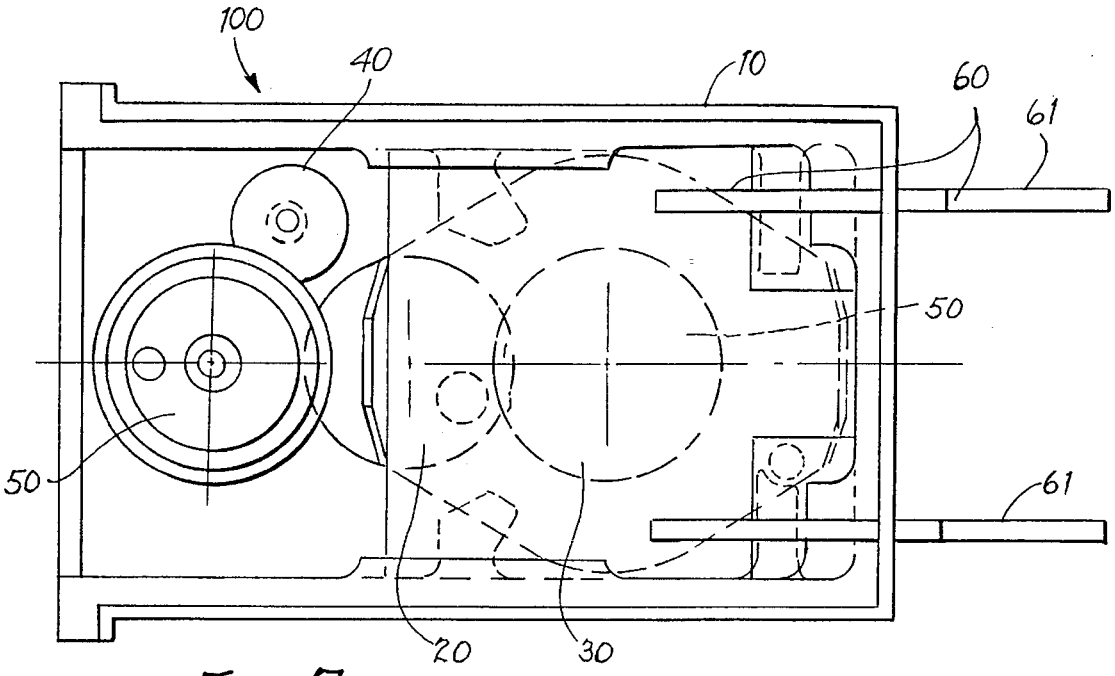
FIG. 7—Top sectional view of the elapsed time hour meter.
Figure 9:
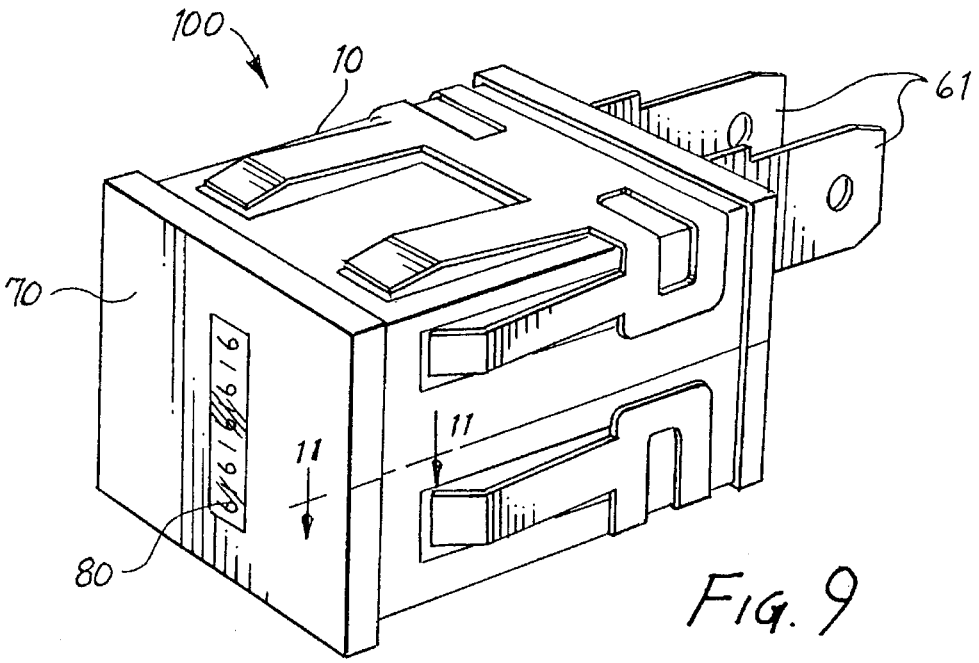
FIG. 9—Perspective view of the assembled elapsed time hour meter.

FIGS. 6, 7, 9 and 10 show the completed assembly of elapsed time hour meter 100 (i.e. FIG. 6 shows a side sectional view, FIG. 7 shows a top sectional view, FIG. 9 shows a perspective view, and FIG. 10 shows a front face view turned 90° counterclockwise from FIG. 9).

As shown in FIGS. 9 and 10, the elapsed time hour meter 100 is assembled to show all 9's on each of the indicator wheels 54, and the elapsed time hour meter 100 is tested by applying power for rotating the counter indicator 50 one-tenth of an hour to allow all of the 9's displayed by indicator wheels 54 to roll over to zero's.

The foregoing description of a preferred embodiment and best mode of the invention known to applicant at the time of filing the application has been presented for the purposes of illustration and description. It is not intended to be exhausted or to limit the invention to the precise form disclose, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined the by claims appended hereto.

To supplement the description of the invention given above, the following are further specifications of a working embodiment:

Choice Of Input Voltage:

4–34 Volts DC

20–100 Volts DC

100–130 Volts AC 50/400 Hz

Power Consumption:

2 mW@24 V DC 40 mW@48 V DC 10 mW@120 V AC

Temperature Range:

−30° to +85° C.

Accuracy:

±0.02%

Seal:

NEMA 12

I claim:

1. An elapsed time meter comprising:

an upwardly open, cup-shaped, lower housing portion supporting in a lower portion thereof an electrical watch movement having a pair of upwardly exposed electrical contact areas and a coupler gear coupled to the watch movement, a downwardly open, cup-shaped upper housing portion supporting a pair of terminals extending externally from the upper housing, a circuit board supported in the upper housing portion in an interior area defined by a perimetric wall of each housing portion and electrically connected to the terminals, the circuit board having regulating circuits and a pair of downwardly extending contact posts for providing electrical power to the watch movement, a rotatable counter coupled to the coupler gear, the upper and lower housing portions being conjoined and supporting therebetween the counter, and, the pair of contact posts in mechanical and electrical contact with the corresponding electrical contact areas on the watch movement, and a display of the elapsed time.

2. The elapsed time meter as claimed in claim 1 further comprising: one contact post being of negative polarity for contacting a leaf spring disposed in a well of the watch movement normally occupied by a battery, and the other contact post being of positive polarity for contacting a positive plate structure of the watch movement.

3. The elapsed time meter as claimed in claim 2 further comprising:

a spring mounted over the positive contact post for providing electrical contact from the circuit board positive contact post to the positive plate structure on the watch movement.

4. The elapsed time hour meter as claimed in claim 1 further comprising:

the lower housing portion having a plurality of L-shaped chairs which directly receive and support the watch movement thereon for operative engagement with the contact areas and gearwork.

5. The elapsed time meter as set forth in claim 1, wherein the electrical watch movement comprises a battery powered, production, analog, wrist watch movement without the battery, face and hands.

6. The elapsed time meter of claim 1 further comprising:

the rotatable counter being supported on at least one shaft one end of which is supported in a recess in the upper housing portion and the other end of which is supported in a recess in the lower housing portion.

7. The elapsed time meter of claim 6 wherein the at least one shaft is two shafts comprising an indicator wheel shaft and an index pinion shaft the ends of each of which are respectively supported in corresponding recesses in the upper and lower housing portions.

8. The elapsed time meter of claim 1 further comprising:

a positioning post on the lower housing portion received within a recess in the watch movement for accurately positioning the watch movement in the lower housing portion in operative relation with the gearwork and circuit board contact areas.

9. The elapsed time meter of claim 1 further comprising:

a minute gear supported on a minute stem of the watch movement, an intermediate gear supported on the lower housing portion, the minute gear directly driving the intermediate gear which directly drives the rotating counter.

10. The elapsed time meter of claim 1 wherein each housing portion supports the counter therebetween.

11. A method of making an elapsed time hour meter comprising the steps of:

providing an upwardly open, cup-shaped, lower housing having a plurality of spaced chairs, at least one shaft recess, and a positioning post, providing an electrically powered watch movement driving a minute gear and having positive and negative contacts, seating the watch movement on the plurality of chairs and positioning post, providing a rotating counter that measures the amount of elapsed time and supporting the counter on at least one rotatable shaft one end of which is received in the lower housing shaft recess, coupling the minute gear of the electrically powered watch movement to the counter, providing a downwardly open, cup-shaped, upper housing having at least one shaft recess, and a circuit board adapted to regulate electrical power from an external electrical power source and having positive and negative contacts for coupling said electrical power to the watch movement, conjoining the lower and upper housings and simultaneously making the respective positive and negative contacts of the watch movement and circuit board and supporting the other end of the counter shaft in the upper housing shaft recess, and displaying the amount of elapsed time.

12. The method of claim 11, wherein the step of providing an electrically powered watch movement includes providing a battery powered, production, analog, wrist watch movement without battery, face and hands.

* * * * *